US005358448A

United States Patent [19]

Stephens

[11] Patent Number: 5,358,448

[45] Date of Patent: Oct. 25, 1994

[54] BUMPER BOWLING GAME AND ERRATICALLY ROLLABLE WEIGHTED BOWLING BALL

[75] Inventor: Michael W. Stephens, Richmond, Va.

[73] Assignee: AMF Bowling, Inc., Mechanicsville, Va.

[21] Appl. No.: 90,240

[22] Filed: Jul. 13, 1993

[51] Int. Cl.[5] ..... A63D 5/00; A63B 43/04

[52] U.S. Cl. ..... 473/113; 473/55; 473/109; 473/116; 273/DIG. 20

[58] Field of Search ..... 273/58 B, 58 F, 128 A, 273/128 CS, DIG. 20; 473/54, 109, 113, 55, 116, 125, 126, 127, 128

[56] References Cited

U.S. PATENT DOCUMENTS 4,194,737 3/1980 Farmer ..... 273/128 A X
4,609,196 9/1986 Bozinovic ..... 273/128 A
4,900,024 2/1990 Chandler et al. ..... 273/51 X
5,181,716 1/1993 Stephens ..... 273/51

*Primary Examiner*—Vincent Millin
*Assistant Examiner*—William M. Pierce
*Attorney, Agent, or Firm*—Bacon & Thomas

[57] ABSTRACT

A bumper bowling game includes an elongated bowling lane and a pair of gutters alongside of the lane. The game also includes a foul line and pin deck at opposite ends of the lane and a plurality of pins on the pin deck. A pair of bumpers temporarily block the gutters to prevent a bowling ball from falling into the gutters. The gutters also redirect a bowling ball which strikes them toward the pins. The game also includes a bowling ball which includes a plurality of finger holes and an eccentric weight for causing the ball to follow an erratic path. The weight may be a fixed weight, free moving within a hollow core, or pendulum-like.

2 Claims, 3 Drawing Sheets

BUMPER BOWLING GAME AND ERRATICALLY ROLLABLE WEIGHTED BOWLING BALL

FIELD OF THE INVENTION

This invention relates to an erratically rollable bowling ball and, more particularly, to a game of bumper bowling in which the bowling ball includes a fixed or free weight which causes the ball to follow an erratic path when rolled along a lane.

BACKGROUND OF THE INVENTION

Bowling alley bumper systems were designed to be used by children as well as others who lack the physical coordination or strength to bowl, i.e., project a majority of the balls over the length of the alley without ending up in one of the gutters. An example of one such system is disclosed my earlier U.S. Pat. No. 5,181,716, which is assigned to the same assignee as the present application and which is incorporated herein in its entirety by reference.

One of the primary purposes of bumper bowling is to introduce children to the game of bowling and at the same time to provide the entertainment and excitement of bowling to a broader segment of the population. Bumper bowling also provides a more interesting game for novice bowlers as they develop their bowling skills.

However, it is now believed that there is a relatively large number of young or novice bowlers who may lack the attention span to enjoy conventional bumper bowling and others who may be discouraged as they see more skillful bowlers progress more rapidly than themselves. For this reason, it is believed that there is a demand for a game of bumper bowling wherein the advantages of skill are minimized and where the path of a bowling ball is unpredictable or erratic as it rolls down the lane.

In the past, there have been several approaches for manufacturing toys or other balls which may follow an erratic path. For example, the U.S. patents of Schultz, U.S. Pat. No. 3,995,855, and Farmer, U.S. Pat. No. 4,194,737, disclose toy or erratically rollable balls which have a counterweight disposed in a hollow core. Such balls may be suitable for play but are not suitable for use in bumper bowling. For example, such balls do not look like an ordinary bowling ball with respect to outer surface, size, texture, hole configuration, hardness and the like. Such balls would not provide the pin action which is desirable in the game of bowling.

It has now been found that a bowling ball, in accordance with the present invention, provides the desired pin action and has the other desirable characteristics of a bowling ball and at the same time provide the random or erratic movement which will hold the attention of younger bowlers in a game of bumper bowling.

BRIEF DESCRIPTION OF THE INVENTION

In essence, a bumper bowling game in accordance with the present invention includes an elongated bowling lane and a pair of longitudinally extending gutters with one of the gutters disposed on each side of the lane. The bumper bowling game also includes a pin deck at one end of the lane and a plurality of bowling pins disposed in a preselected pattern on the pin check. The game further includes a foul line at the opposite end of the lane from the pin deck and means, such as a pair of bumpers, for temporarily blocking the gutters for preventing a bowling ball from falling into the gutter and redirecting the ball toward the pin deck. In addition, the bumper bowling game disclosed herein includes a bowling ball which includes a number of finger holes, other characteristics of a conventional bowling ball and means for causing the ball to follow an erratic path when rolled along the lane.

A bowling ball in accordance with a preferred embodiment of the invention is intended for use in a game of bumper bowling. The ball comprises an outer shell and an inner core which is surrounded by or defined by the outer shell. The ball also includes a plurality of finger holes and an eccentric weight which may be fixed or movable. The weight, which is preferably movable, is disposed within a preferably hollow core and separated from the finger holes. The eccentric weight causes the ball to follow an erratic path as it is rolled along the lanes.

DESCRIPTION OF THE PREFERRED EMBODIMENTS

Figure 1:
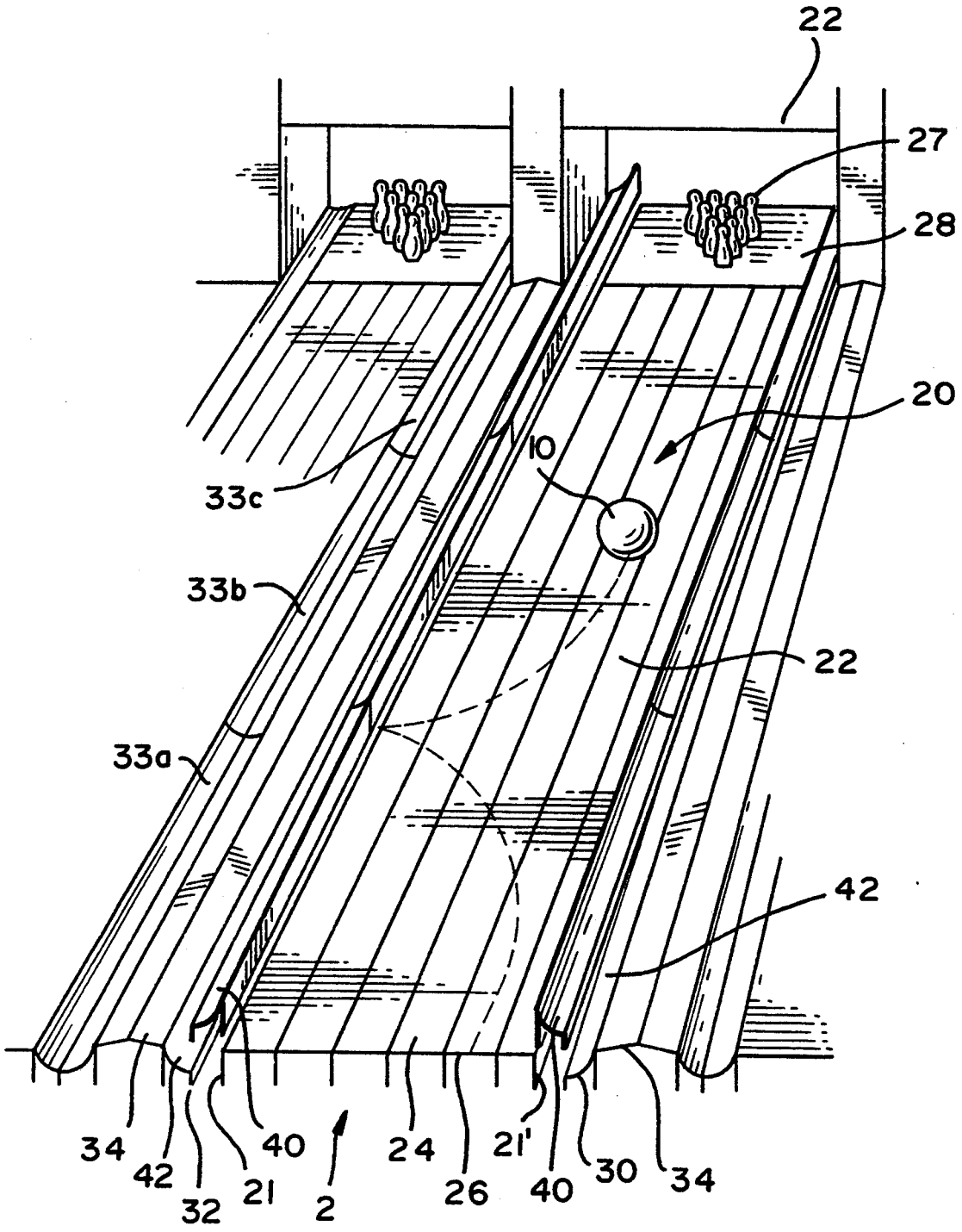
FIG. 1 is a perspective view of a bowling alley bumper system and bowling ball with an erratic ball path shown in dotted lines.

The invention will now be described in connection with the accompanying drawings wherein like reference numerals have been used to designate like parts.

As illustrated in FIG. 1, a bowling alley 2 typically includes a longitudinally extending lane 20 which defines a flat horizontal plane or an upper surface thereof and which is typically made up of a plurality of parallel abutting strips of wood 22, 24. The alley includes a foul line 26 which extends across the lane 20 and perpendicular to the longitudinal axis of the lane. The foul line 26 indicates that area beyond which a bowler may not pass in releasing a bowling ball during a game of bowling. A pin deck 28 is disposed at the opposite end of the lane 20 and is adapted to receive a plurality of bowling pins 27 thereon. The bowling alley may be set with the pins in a customary triangular pattern with one pin, the head pin in front, a second row of two pins, a third row with three pins and a final of four pins. The pins may also be set in other preselected patterns to provide further variety for young bowlers.

A pair of longitudinally-extending gutters 30, 32 are disposed along the side of the lane 20 with one gutter on each side of lane 20 in a customary manner, i.e., adjacent to and in substantially abutting relationship with the lane. In conventional bowling, the gutters 30, 32 are adapted to receive any balls that are bowled toward one side of the lane and to direct any misdirected balls to the end of the alley. Also illustrated are capping members 34 which separate the adjacent alleys or lanes.

Figure 2:
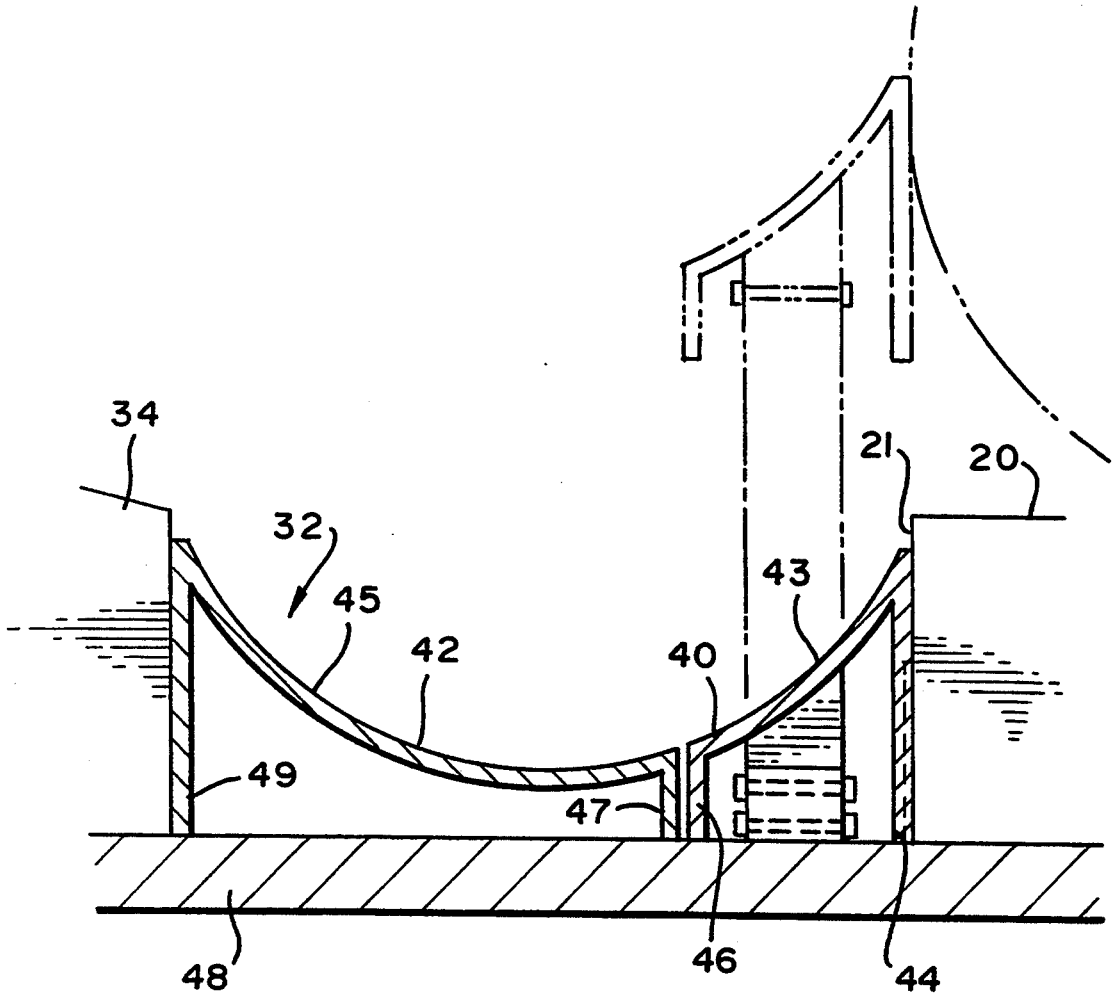
FIG. 2 is an end view of a portion of the bowling alley bumper system shown in FIG. 1 which illustrates the bumper mechanism.

The mechanism for bumper bowling is illustrated more clearly in FIG. 2. As illustrated therein, a bumper bowling system is incorporated in the bowling alley 2 which includes two sides 21, 21' (FIG. 1) and a longitudinally extending lane 20 on an upper surface thereof. In a preferred embodiment of the invention, each of the gutters 30, 32 define first and second concave, longitudinally extending portions 40, 42. The first portion 40 defines an arc-shaped concave surface 43 which forms a part of the gutter 32 and, in one example, forms about one-third of the gutter when viewed in cross section. The portion 40 also includes a pair of downwardly extending projections 44, 46 which are preferably parallel to one another. The projections 44, 46 support the portion 40 on a suitable base such as a plurality of cross members 48. The first projection 44 is adjacent to and abuts side 21 and is constructed and arranged to slide upwardly therealong. The projection 44 may also include a resilient bumper (not shown) recessed thereon for engaging a bowling ball which is directed toward the bumper.

The second longitudinally extending portion 42 also defines an arc-shaped concave surface 45 which, in the example, forms the outer two-thirds of gutter 32. The portion 45 also includes a pair of downwardly extending parallel projections 47, 49. The projections 47, 49 are fixed to the cross member 48 in a customary manner with a first of the projections 47 adjacent to and abutting projection 46. The second projection 49 is adjacent to and abutting capping member 34 which separates a pair of alleys.

For conventional bowling, the longitudinally extending portions 40 are positioned in the lower or retracted position shown in FIGS. 1 and 2. However, where it is desired to convert the lane to bumper bowling as defined more clearly in the aforementioned patents of Conklin et al. and Chandler et al., each of which is incorporated herein in its entirety by reference, the portion 40 is raised upwardly along an arc. For example, the portion 40 may be moved upwardly by means of a crank arm (not shown) to the position shown by the broken lines in FIG. 2.

Figure 3:
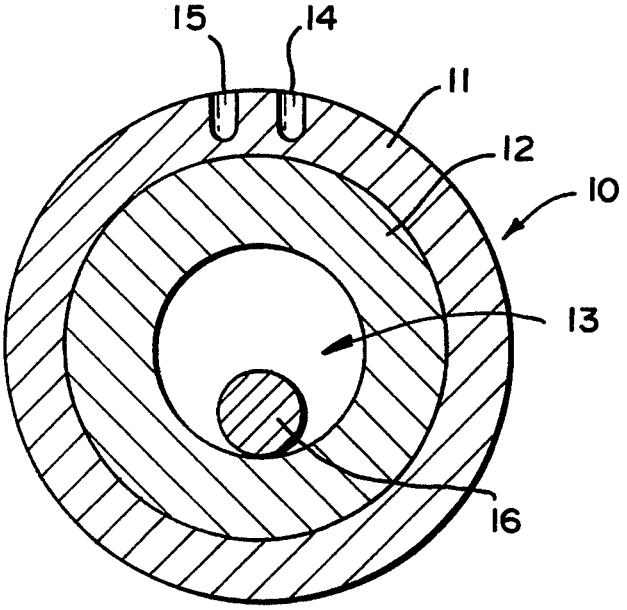
FIG. 3 is a cross-sectional view of a bowling ball in accordance with a first embodiment of the invention.

A bowling ball 10 in accordance with a presently preferred embodiment of the invention is shown in FIG. 3. The ball 10 looks and feels like a conventional bowling ball with respect to outer surface, texture, size, hole configuration and weight. However, at times it may be desirable to have a ball of reduced weight for use by younger children or by physically-impaired bowlers.

The ball 10 is intended for use with a bumper bowling system but should preferably exhibit the high performance striking power and hooking characteristics of a bowling ball such as the type which incorporates an outer polyurethane semi-rigid shell. The outer polyurethane shell may, for example, incorporate a sulfur-vulcanizable rubber such as SBR rubber or natural rubber as disclosed in U.S. Pat. No. 4,461,478 (Lee et al.) which is incorporated herein in its entirety by reference.

Figure 5:
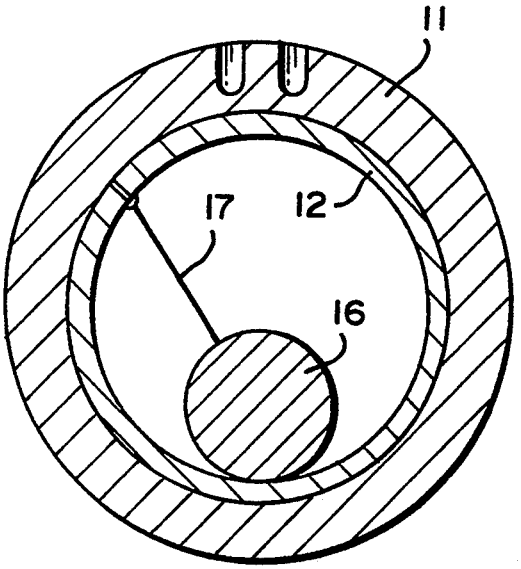
FIG. 5 is a cross-sectional view of a bowling ball in accordance with a third embodiment of the invention.

The ball 10 may also include a spherical solid core 12 which is typically a rubber core filled with an inert filler. The solid core 12 also defines a hollow core 13. The core 12 may be of a rubber which is compounded for extra hardness and weight to compensate for the hollow center. The hollow core 13 may also be off center as illustrated in FIG. 3. In a further embodiment, the hollow core 13 may be concentric with the solid core 12 as illustrated in FIG. 5.

Referring to the embodiment of FIG. 3, a relatively small but relatively heavy inner ball 16 is enclosed within the hollow core 13. This inner ball 16 continuously shifts its position and contributes to the erratic behavior of the ball as it is bowled. This erratic movement may produce a wobble or result in the ball 10 curving toward one of the bumpers as illustrated by the dotted line in FIG. 1.

The ball 10 also include a plurality of finger holes 14 and 15 and means such as a portion of outer shell 11 or solid core 12 for protecting the ends of the fingers from any movement of inner ball 16. For example, in its preferred form, the finger holes 14 and 15 are drilled into the ball and are surrounded by outer shell 11 and perhaps by a portion of the solid core 12, which prevents the fingers from being extended into the hollow core or being struck by inner ball 16.

Figure 4:
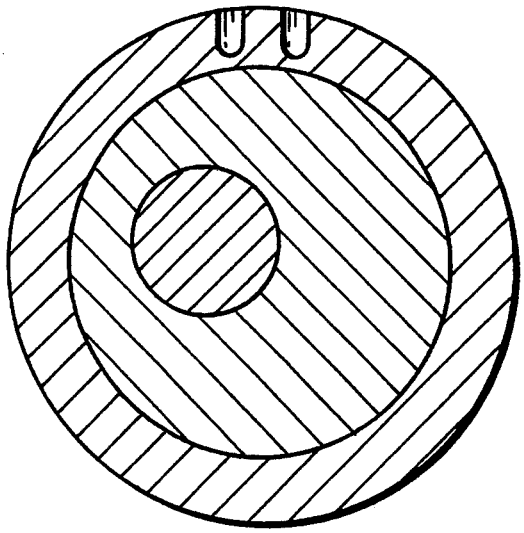
FIG. 4 is a cross-sectional view of a bowling ball in accordance with a second embodiment of the invention.

A second embodiment of the invention is illustrated in FIG. 4 wherein the ball 10 includes a solid core 12 which encases a fixed inner weight 17. This inner weight, which might be made of a heavy or relatively dense metal, is fixed within the ball but off center to provide the desirable erratic movement of the ball.

FIG. 5 illustrates a third embodiment of the invention wherein a pendulum-like weight, such as a relatively small but relatively dense inner ball 16, which may be in the form of a weighted mass such as a pendulum, is disposed at one end of a pivotal rod 17 within the hollow core 13. As illustrated, the pivotal rod 17 is fixed within the solid core 12 or shell 11 at one end thereof and includes a pivotal connection 18. The weighted mass or inner ball 16 is fixed at the opposite end of rod 17 and allows limited movement of the ball 16 during any movement of the ball 10. This limited movement of the pendulum-like element produces an unusual wobble or erratic movement of the ball 10 as the ball 10 is rolled or bowled down the lane 20.

While the invention has been described in connection with one of its preferred embodiments, it should be understood that changes and modifications may be made without departing from the scope of the appended claims.

What is claimed is:

1. A bumper bowling game comprising an elongated bowling lane anti it pair of longitudinally extending gutters with one of said gutters adjacent to and extending along each side of said lane; a foul line disposed at a first end of said lane and a pin deck disposed at the opposite end of said lane; a plurality of bowling pins disposed on said pin deck and a pair of retractable bumpers for blocking said gutters to thereby prevent a bowling ball from falling into said gutters when said retractable bumpers are in an extended position and for allowing a bowling ball to fall into said gutters when in a retracted position; a bowling ball for rolling along said lane and toward said pins, said bowling ball comprising an outer semi-rigid shell portion and an inner hollow core portion surrounded by said outer shell and including means for defining a plurality of finger holes within said outer shell portion, means including a relatively small but relatively heavy off-center weight disposed in said inner core for causing said ball to follow an erratic path when rolled on said bowling lane, means for separating said finger holes from said off-center weight and wherein said bowling ball includes a hollow core having an inner wall, a pivotable rod disposed in said hollow core and pivotally fixed at one end thereof to said inner wall and a pendulum-like weight fixed to an opposite end of said pivotable rod and suspended within said hollow core.

2. A bumper bowling game comprising an elongated bowling lane and a pair of longitudinally extending gutters with one of said gutters adjacent to and extending along each side of said lane; a foul line disposed at a first end of said lane and a pin deck disposed at the opposite end of said lane; a plurality of bowling pins disposed on said pin deck and a pair of retractable bumpers for blocking said gutters to thereby prevent a bowling ball from falling into said gutters when said retractable bumpers are in an extended position and for allowing a bowling ball to fall into said gutters when in a retracted position; a bowling ball for rolling along said lane and toward said pins, said bowling ball comprising an outer semi-rigid shell portion and an inner hollow core portion surrounded by said outer shell and including means for defining a plurality of finger holes within said outer shell portion, means including a relatively small but relatively heavy off-center weight disposed in said inner core wherein said bowling ball includes a hollow core and said off-center weight is an inner relatively-dense and smaller ball which moves freely about within said hollow core when said bowling ball is rolled along said lane for causing said ball to follow an erratic path when said bowling ball is rolled along said lane and means for separating said finger holes from said off-center weight.

* * * * *